United States Patent [19]

Köbler et al.

[11] Patent Number: 4,807,865

[45] Date of Patent: Feb. 28, 1989

[54] PAPER HANDLING APPARATUS FOR RECEIVING ADJACENTLY POSITIONED PAPER SHEETS, TRANSPORTING AND DEPOSITING THE SHEETS, SPREAD-APART, IN A RECEIVING SYSTEM

[75] Inventors: Ingo Köbler, Anhausen; Godber Petersen, Augsburg, both of Fed. Rep. of Germany

[73] Assignee: MAN Roland Druckmaschinen AG, Offenbach am Main, Fed. Rep. of Germany

[21] Appl. No.: 56,857

[22] Filed: May 29, 1987

[30] Foreign Application Priority Data

Jun. 28, 1986 [DE] Fed. Rep. of Germany ..... 3621822

[51] Int. Cl.[4] ..... B65H 39/02

[52] U.S. Cl. ..... 270/54; 270/58

[58] Field of Search ..... 270/8–9, 270/11–13, 14–15, 38, 47, 48, 54, 58, 45, 55, 56, 20.1; 198/424, 626, 644; 493/405, 409, 416, 417, 426, 432

[56] References Cited

U.S. PATENT DOCUMENTS

| | | | |
|---|---|---|---|
| 4,285,509 | 8/1981 | Reid | 270/54 |
| 4,344,610 | 8/1982 | Jeschke et al. | 270/60 |
| 4,465,269 | 8/1984 | Petersen | 270/47 |
| 4,497,479 | 2/1985 | Pessina et al. | 270/54 |
| 4,605,212 | 8/1986 | Kobler | 270/54 |

FOREIGN PATENT DOCUMENTS

| | | | |
|---|---|---|---|
| 2541502 | 3/1977 | Fed. Rep. of Germany | 270/47 |
| 3527710 | 2/1987 | Fed. Rep. of Germany | 270/45 |
| 3534157 | 4/1987 | Fed. Rep. of Germany | 270/47 |

*Primary Examiner*—Robert E. Garrett
*Assistant Examiner*—Therese M. Newholm
*Attorney, Agent, or Firm*—Frishauf, Holtz, Goodman & Woodward

[57] ABSTRACT

To permit introduction of adjacently located sheet elements (20, 22), for example folded sheets (24), received from a folding flap cylinder (2), with the fold line or spine leading and with the sheet elements spread apart, a guide belt (13) has laterally projecting fingers (12) which engage between the sheet elements (20, 22), the guide belt being positioned adjacent to and operating at essentially the same speed as a pair of transport belts (25, 26) between which the sheet elements are being transported. The fingers are inserted between the sheet elements as a sheet (24) is folded or two individual sheet elements are gripped by a folding flap or gripper cylinder (2), and remain between the sheet elements upon transport by the transport belt system. At a delivery region, adjacent a storage unit, the guide belt is deflected over a roller, thereby twisting the fingers and spreading the sheet elements apart adjacent their trailing ends, by guiding the guide belt in a path different from the transport belt system. Preferably, the spread-apart sheet elements are transferred to an accordion or zig-zag pocket structure, for example made of elastic sheet elements, which, to receive the spread-apart sheet elements, has the accordion pockets spread, for example for a worm (50).

24 Claims, 12 Drawing Sheets

PAPER HANDLING APPARATUS FOR RECEIVING ADJACENTLY POSITIONED PAPER SHEETS, TRANSPORTING AND DEPOSITING THE SHEETS, SPREAD-APART, IN A RECEIVING SYSTEM

Reference to related applications, assigned to the assignee of the present invention, the disclosure of which is hereby incorporated by reference:

U.S. Ser. No. 07/056,786, pending, filed May 29, 1987, Kobler et al;

U.S. Ser. No. 07/060,764, pending, filed June 10, 1987, Kobler et al;

U.S. Ser. No. 07/056/786, filed May 29, 1987, Petersen;

U.S. Pat. No. 4,465,269, Petersen, and

U.S. Pat. No. 4,605,212, Kobler, both assigned to the assignee of the present application, the disclosures of which are hereby incorporated by reference.

The present invention relates to material handling apparatus to handle material in sheet form, and more particularly to paper handling apparatus receiving printed sheets which are being folded, or two separate sheets placed next to each other, for transport to a storage unit in such a manner that adjacent sheets are spread apart to permit insertion of additional sheet material between the spread-apart sheets.

BACKGROUND

The referenced U.S. Pat. No. 4,465,269, Petersen, describes a folding apparatus in which a transport belt system is guided about a folding flap cylinder to receive transversely folded printed substrates, typically paper, for further transport to a further paper handling apparatus.

U.S. Pat. No. 4,605,212, Kobler, assigned to the assignee of the present invention, describes an arrangement in which folded printed substrates are transported by transport elements, received from a folding flap cylinder, in which the transport elements are spaced from each other and which engage behind the spine or fold line of the folded product in the essentially wedge-shaped region behind the transfer position of the folded product from the collection or folding blade cylinder to the folding flap cylinder.

If it is desired to place a special insert in the folded substrates as received from the structure described in the referenced U.S. Pat. No. 4,465,269, Petersen, it is necessary to provide a separate apparatus such as an opening cylinder which engages at an overfold. This necessarily leads to an excess paper consumption and requires additional space and costs. The apparatus described in the referenced Kobler U.S. Pat. No. 4,605,212 is substantially more compact and does not require an overfold. However, it is not easily possible to transport the folded product with the spine or folding edge at a leading position, with respect to transport direction.

THE INVENTION

It is an object to provide an apparatus to receive folded substrates, or two adjacent sheets of substrates, from a cylinder on which the adjacent sheets are gripped, for example a folding flap cylinder if a single sheet has been folded, and transport the folded sheets to a storage apparatus in such a manner that the adjacent sheets can be spread apart, that is, the fold can be opened, while transfer or delivery of the adjacent sheets, or folded sheets, preferably with the fold or junction edge of the adjacent sheets being in a leading direction, with respect to the transport movement.

Briefly, a transport belt system is provided, positioned to transport sheets from a rotating cylinder to a storage unit. An endless belt is located adjacent at least part of the path of the transport belt system. The endless belt has a plurality of fingers which project laterally therefrom, and engageable between adjacent sheets, or adjacent folds of a sheet being folded, while the adjacent sheets are still positioned at least in part on the rotating cylinder. The endless belt is controlled to operate in a path which differs from the path of the transport belt system at least in a region adjacent the storage unit to permit withdrawal of the fingers from between the sheets or folds of the sheets, upon transfer of the folded or adjacent sheets to the storage unit.

In accordance with a feature of the invention, the endless belt operates at a speed somewhat slower than the speed of the transport belts, so that the position of the fingers inserted between the sheets or sheet folds shifts from a position close to the junction or fold line of the sheets towards a trailing portion thereof during transport of the sheets, so that when the sheets are close to the storage unit, the fingers will be in a position near the trailing end, thereby spreading the trailing ends of the sheets apart and permitting engagement of further spreading and transport apparatus.

The arrangement has the advantage to transfer sheets or folded sheets of substrate material, typically, but not necessarily, paper, from a folding apparatus and transfer the sheets directly to a storage unit while spreading adjacent sheets apart. Later on, the storage unit which is preferably in form of a zig-zag arrangement can again be spread apart so that adjacent sheets will be spread apart and thereby can readily accept insert substrates and the like, for mixing and collecting and associating sheets and inserts of various information content.

DRAWINGS

DETAILED DESCRIPTION

The present invention will be described in connection with a folding apparatus which receives printed paper sheets from a printing machine. The sheets may have been severed from a continuous web. The invention is not limited, however, to paper sheets which are being folded; it is equally applicable to transport and spread apart two closely adjacent sheets. In a folding apparatus, a folding cylinder with a folding blade is used. If individual dual sheets are to be transported, no folding blade is needed and, rather than using a folding flap cylinder, a transport cylinder with grippers could be used. For simplicity, however, the invention will be described in connection with sheets which are folded. The modification to handle single sheets is then obvious.

Figure 1:
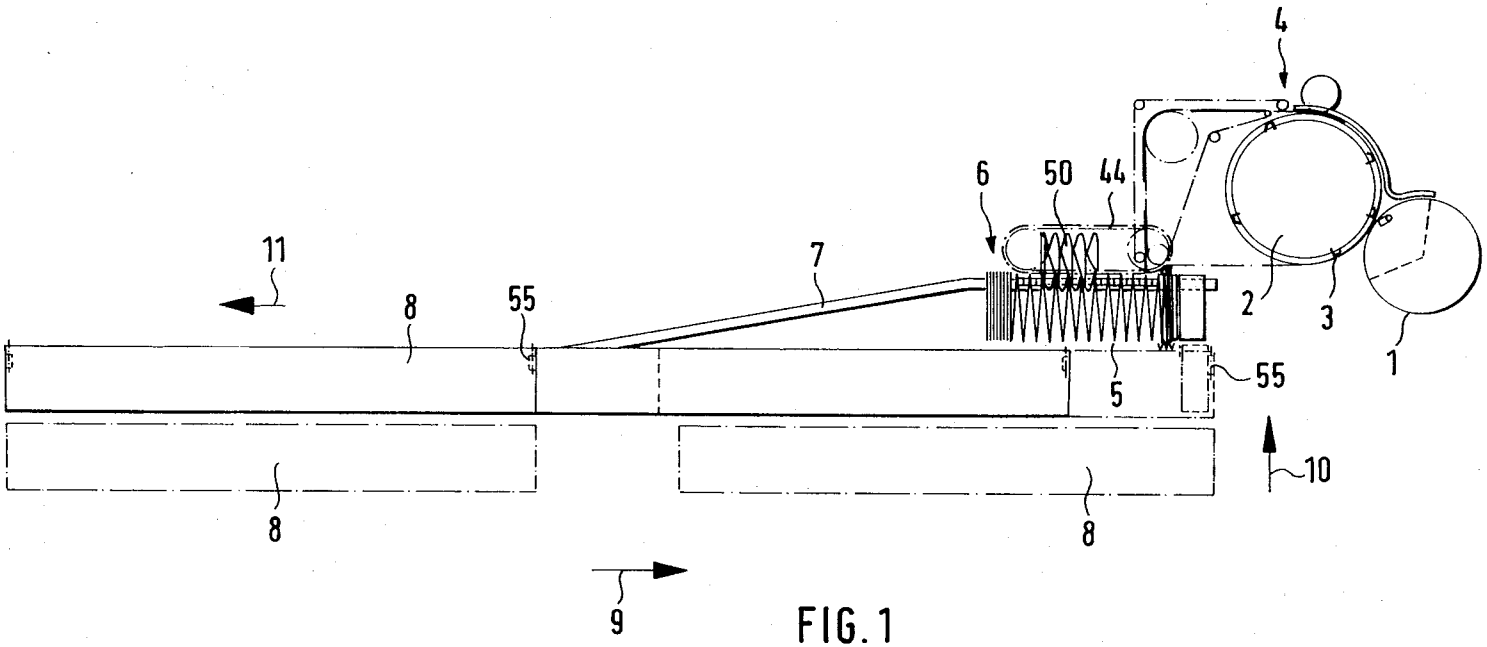
FIG. 1 is an overall highly schematic side view of the apparatus, omitting parts not necessary for an understanding of the invention.

As shown in FIG. 1, a sheet supply means is provided which includes a collection cylinder 1 has a folding flap cylinder 2 positioned in cooperating arrangement therewith. Folding flap cylinder 2 is formed with folding flaps 3. Folded sheets are removed from the folding flap cylinder in the region 4 and received in a receiving system, shown as a transport and storage system 5. The storage system itself preferably includes a plurality of accordeon-pleated segments which can be spread apart or pushed together. These segments are made of elastic sheet elements, alternatively connected together at their upper and lower edges. To receive folded sheets, they can be spread apart, and thereafter collapsed again for compact storage. Storage units of this kind are described in the referenced copending application Ser. No. 07/056,786, filed May 29, 1987, by the inventors hereof.

Associated transport apparatus for such a storage unit is described in the copending application Ser. No. 07/060/764, filed June 10, 1987, by the inventors hereof.

The zig-zag or accordion-plated sheets are pushed together in the region 6 for compact storage. Rails 7 can be used to transport the entire storage sheets to a holder unit or cassette 8. The supply of sheets and storage can be continuous. Empty holders 8 are supplied in the direction of the arrow 9, raised in the direction of the arrow 10, and are continuously fed with folded sheets and continuously transported, when full, in the direction of the arrow 11 to other holder units 8.

Figure 2:
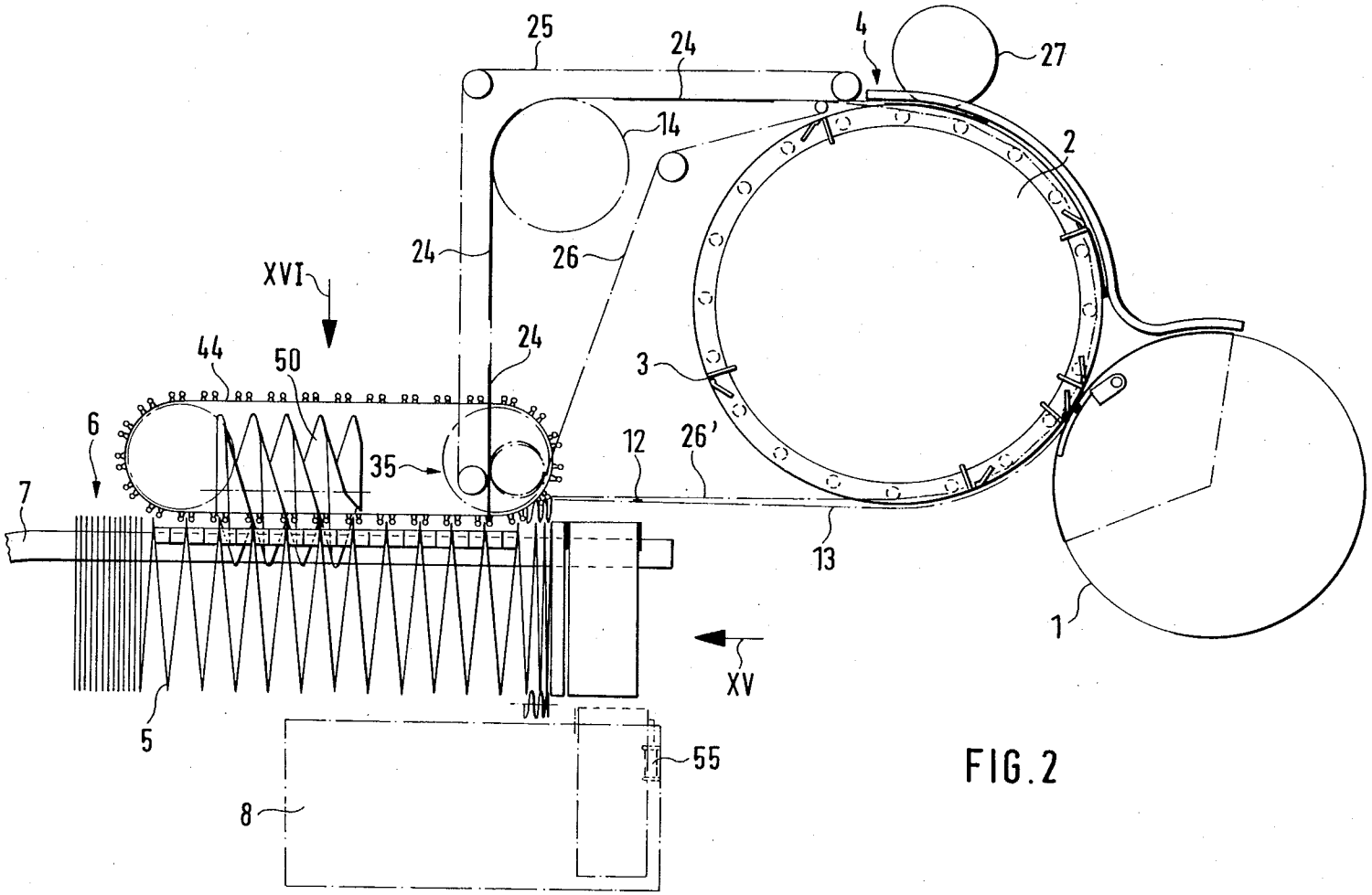
FIGS. 2 and 3 are respectively enlarged fragmentary views of the apparatus of FIG. 1.
Figure 3:
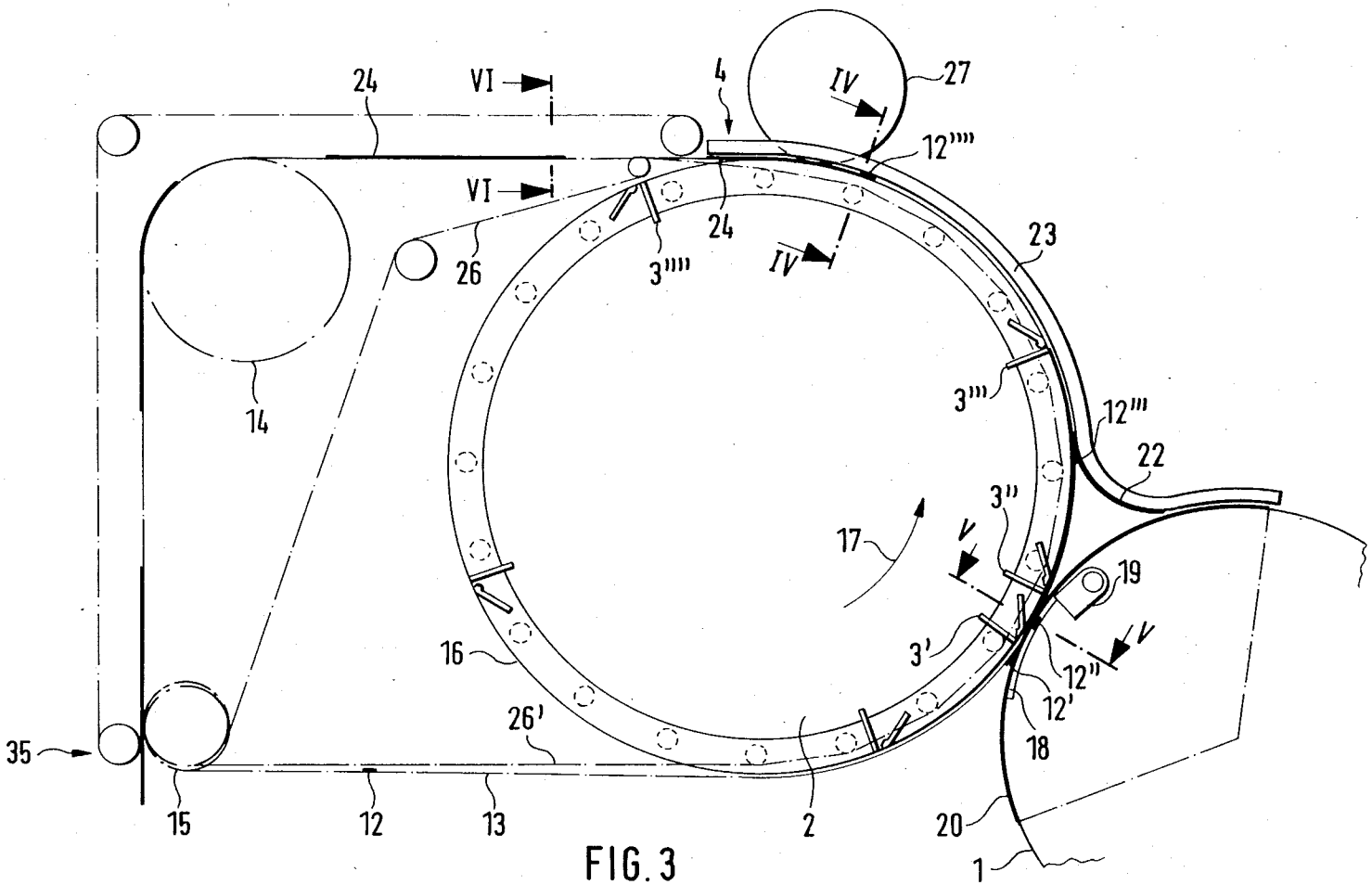
Figure 5:
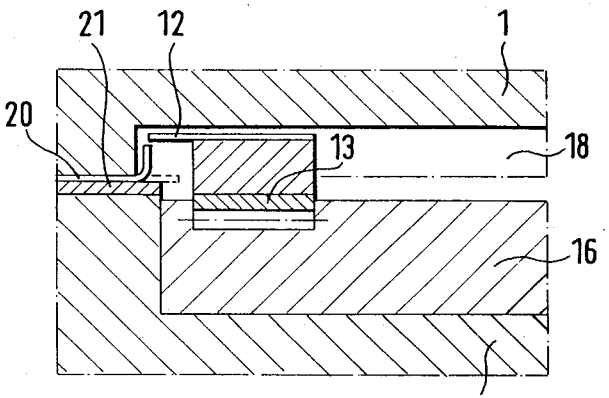
FIG. 5 is a section along line I—I of FIG. 3.

Referring now to FIGS. 2 and 3, and especially to FIG. 3: In accordance with a feature of the invention, a transport arrangement, preferably in form of a gear belt 13, has fingers 12 secured thereto, spaced from each other. The fingers 12 project laterally from the belt 13. The belt 13 and the fingers 12 operate at a speed which is preferably slightly less than the circumferential speed of the folding flap cylinder 2. The belt 13 is guided over a drive wheel 14 for example in form of a sprocket, and over a deflection wheel 15. It then passes about a freely rotatable disk 16 (FIGS. 4, 5) located at an end face of the folding flap cylinder 2. Preferably, the disk 16 is carried along by engagement with the gear belt 13. Its speed will be somewhat less than the speed of the folding flap cylinder 2 itself. The gear belt 13 and the fingers 12 are so driven and so arranged that, in clocked synchronism with the rotation of the folding flap cylinder 2, the fingers 12 can engage in a recess 18 of the collection cylinder 1 when they are positioned at the location 12′ (FIG. 3) with the fingers and the folding flap cylinder operating in the direction of rotation of arrow 17 (FIG. 3). The position 12″ illustrates maximum engagement depth of the fingers 12. The folding flaps 3 in the folding flap cylinder 2 will have moved to the position 3″, and receive a sheet to be folded. Of course, it could be a group of sheets, rather than a single sheet, if the collection cylinder 1 receives a group of sheets at a time. The sheet or group of sheets are transferred from a folding blade apparatus 19 to the folding flaps of the folding flap cylinder 2. This transfer is well known and standard in the field. FIG. 5, which is a section along line I—I of FIG. 3, illustrates the course of the engagement of the finger 12 over the trailing portion 20 of a sheet forming one sheet element of a folded element 24. The folding element 24 is placed on a foam layer 21; the two folded halves, namely the sheet elements 20, 22, are still engaged on the foam layer 21 and pressed between the two cylinders 1, 2. This facilitates the overlap movement of the finger 12 laterally over the edge of the sheet. Due to centrifugal force, and as seen in FIG. 5, the sheet half 20 deflects somewhat into the recess 18 of the collection cylinder 1 for a short period of time; it will snap or resiliently return to its prior flat position and then will come under or beneath or behind the finger 12.

Upon further rotation of the cylinder 2 and the disk 16 in the direction of arrow 17, the fingers 12 will trail more and more behind the folding flap 3 in which the folded edge or spine of the sheet is gripped. This is due to the speed difference, above referred to, of the gear belt 13 and the folding flap cylinder 2.

At the position 12‴, the leading sheet element 22 will position itself over the finger 12. At that point, the folding flap 3 has already reached the position 3‴. The speed difference between the folding flap 3 and the fingers 12 is so matched to each other that the finger 12, in the position 12⁗, will be approximately close to the end of the folded sheet 24, looked at in the direction of rotation.

Figure 4:
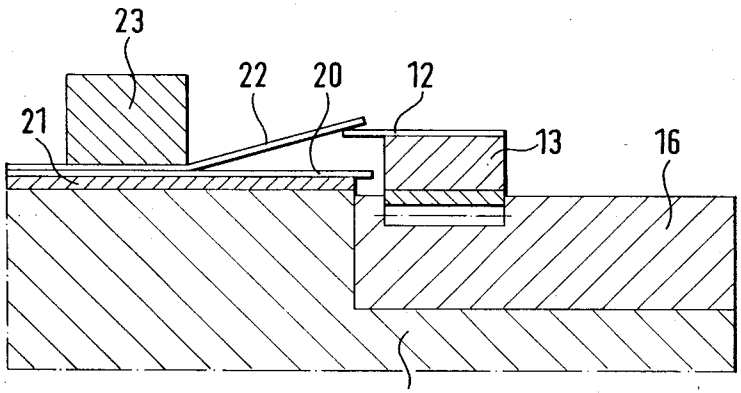
FIG. 4 is a section along line II—II of FIG. 3.

FIG. 4 is a cross-sectional view along line II—II of FIG. 3, illustrating the position of the finger at the position 12⁗. The fingers 12 are between the sheet elements or halves 20, 22. A sheet guide structure 23 supports the folded elements 24, as well known, with respect to centrifugal force.

At the region 4 of FIG. 3, the folding flap 3 will be in the position of 3⁗ and has, at that position, already released the folded sheet 24. Transport now is carried out by transfer to a belt system formed by belts 25, 26, as well known, by a transport roller 27. The transport speed of the belt system 25, 26 corresponds to the operating speed of the gear belt 13 and hence of the fingers 12. This speed is slower than the operating speed of the cylinders 1 and 2, as noted above.

The folded products 24 are guided between the belts 25, 26; the gear belt 13 with the fingers 12 operates adjacent these belts. The folded elements 24 are braked or retarded in the region 4 and then further transported by the belt systems 25, 26 with reduced speed. The belt 26 can be guided in the path shown at 26′ in FIG. 3, as well known, passing about the folding flap cylinder 2. This improves lifting-off of the folded sheet elements in the region 4.

Figure 6:
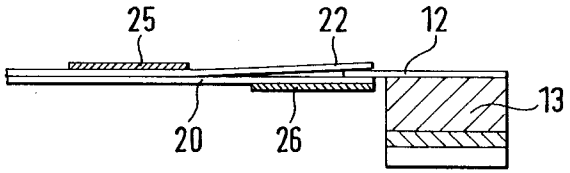
FIG. 6 is a section along line III—III of FIG. 3.

FIG. 3 is a section along line III—III of FIG. 6, and illustrates the position of the folded elements 24 after they left the folding flap cylinder 2. The fingers 12 are between the sheet elements 20, 22, that is, within the fold of a folded sheet 24. The sheet elements 20, 22 are guided between the belts 25, 26 and transported thereby.

Figure 8:
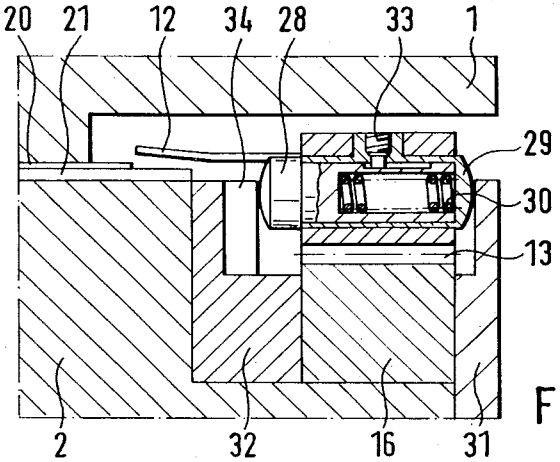
FIG. 8 is a view similar to FIG. 7 and illustrates the position of the finger just in advance of the position shown in FIG. 7.
Figure 7:
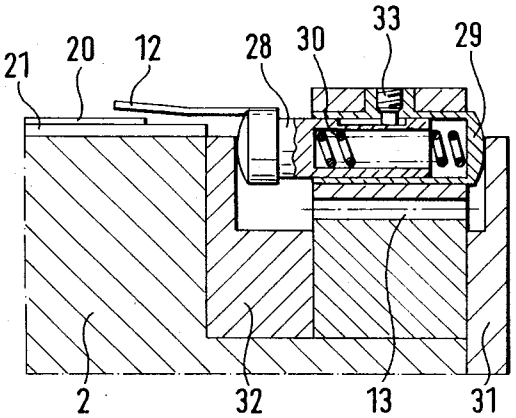
FIG. 7 is a sectional fragmentary side view of a finger which is modified from the fingers of FIGS. 3 to 6, and illustrating the modified finger in the position illustrated by section line I—I of FIG. 3.
Figure 9:
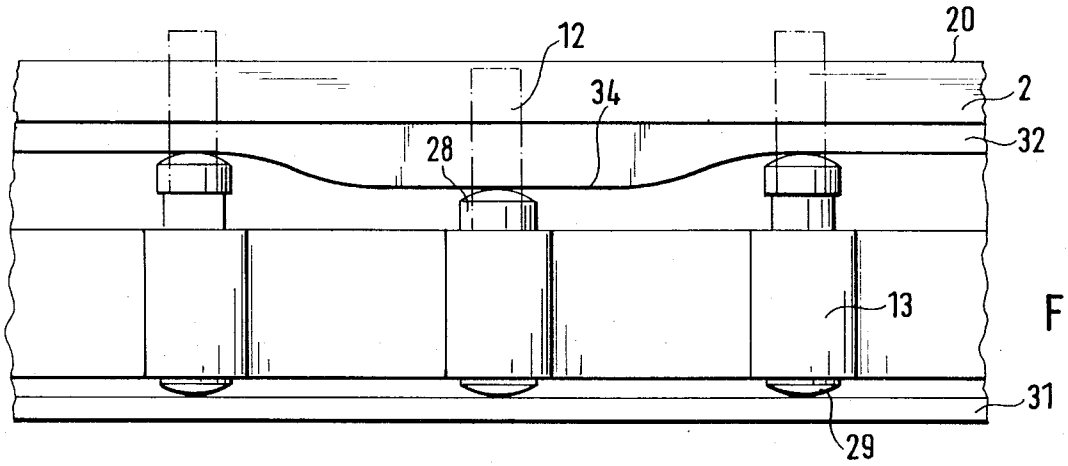
FIG. 9 is a top developed view, schematically showing the positioning of the fingers in various positions of the fingers along the circumference of a folding cylinder.

The fingers can be arranged differently. FIGS. 7 to 9 show another embodiment and another possibility of penetrating the fingers 12 between sheet elements.

Each one of the fingers 12 is secured to a bolt 28 which is journalled in a housing 29, supported by springs 30. The entire arrangement is embedded in the gear belt 13. The springs 30 have their spring pressure accepted by a support disk 31 via housing 29; the bolts 28 are pressed by spring 30 against a cam disk 32 secured to the folding flap cylinder 2. A set screw or positioning pin 33 prevents rotation of the bolt 28.

The gear belt 13 operates on the disk 16 with slower speed than the folding flap cylinder 2 and the bolt 28 and hence the finger 12 are axially controlled by the cam disk 32, secured to the folding flap cylinder 2.

FIG. 8 shows the positions of the bolts at position 12', that is, in advance of section line I—I. The sheet element or half 20 is positioned on the cylindrical surface of the folding flap cylinder 2. Tongue 12 is axially withdrawn, and does not touch the sheet. Upon rotation of the folding flap cylinder 2, and hence movement of the belt 13 in the direction of the arrow 17, the finger 12 will shift to the position 12", shown at section line I—I in FIG. 3. The cam disk 32, at position 12", permits axial shifting of the bolt 28, so that the finger 12 will engage the sheet half or sheet element 20 of the folded sheet 24, and the sheet half 22 can thus engage above and over the finger 12. After leaving the folding flap cylinder 2 in the region 4, the spring 30 retains the finger 12 in its axial position.

FIG. 9 is a developed top view illustrating the position of the finger 12 at various circumferential positions around the circumference of the folding flap cylinder 2. The cylinder surface of the folding flap cylinder 2 and cam disk 32 as well as support disk 31, in the illustration shown, move from the right towards the left. The speed of the bolts and hence of the finger in horizontal direction (FIG. 9) is less than the speed of the folding flap cylinder 2. This relative speed pulls the bolt 28 over the cam disk 32 and can thus carry out an axial stroke in accordance with the cam curve 34.

INTRODUCING FOLDED SHEETS INTO TRANSPORT AND STORAGE UNITS

The folded sheets, being transported between belts 25, 26, are transported to a region 35 (FIGS. 2, 3, 10) for transfer of the folded elements 24 to the transportation and storage system 5. Upwardly, in FIG. 10, of deflector wheels 15 and 47, the gear belt 13, with the fingers 12, follows the path or running course of the belts 25, 26.

Figure 10:
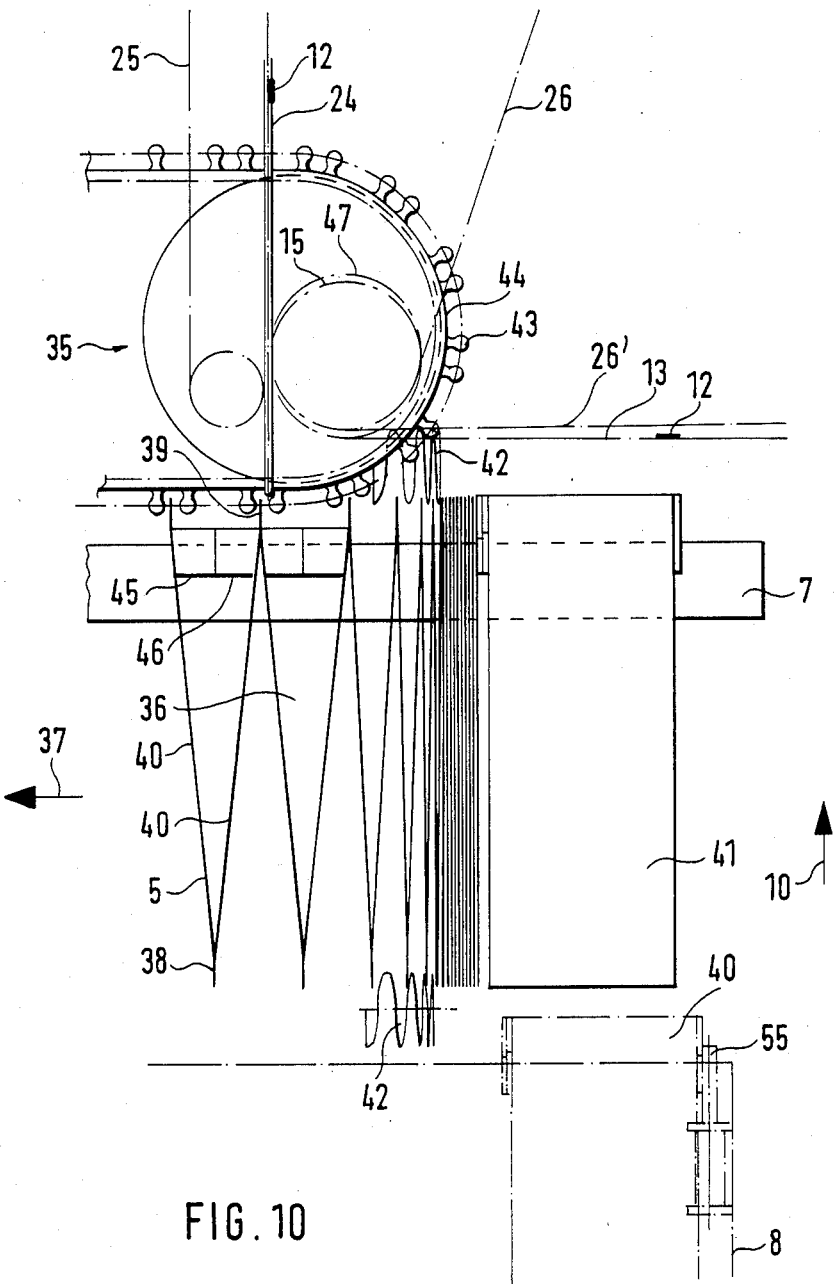
FIGS. 10 through 14 illustrate, schematically, the feeding of paper sheets to a storage unit in clock or synchronized movement with the transport belt system.

FIG. 10 illustrates, to an enlarged scale, the region 35. The folded unit 24, preferably in vertical direction, leaves the belts 25, 26, with the spine or fold line in leading position with respect to movement of the folded elements 24. As seen in FIG. 10, a unit 24 engages in a spreadapart or open chamber of the zig-zag or accordeon-shaped storage structure which is moved in the direction of the arrow 37. This structure is formed of elastic sheet elements 40, for example sheet-metal or plastic sheets, which are connected with each other, alternately at the top or bottom, as shown at reference numbers 38, 39 in FIG. 10. They can be pulled apart and compressed. For compact storage, they are placed tightly engaged against each other in form of a sheet package 41. An apparatus as described in the referenced application U.S. Ser. No. 07/060,764, filed June 10, 1987, Kobler et al, permits removal from a holder 8 and placement in the direction of the arrow 10 on rails, for movement along the arrow 37 with a predetermined speed. This speed, or, in other words, the removal speed of the sheets 40 from the package 41, is synchronized. The removal of the sheets 40 is obtained by a worm gear 42 having a worm 50 (FIG. 15), the pitch of which, looked at in the direction of the arrow 37, becomes larger and larger. Thus, the sheets 40 are pulled more and more apart with increasing feed distance and, thereafter, are connected to synchronously operating transport elements 43. Transport elements 43 are secured to a chain or to a gear belt 44 and move the transport and storage system in the direction of the arrow 37. Bowed or arch-shaped tongues 45, 46, which are resiliently compressible, insure spacing of the sheet halves 20, 22 within the sheet package 41, and facilitate the engagement of the worm 50. Tongues 45, 46 are seen in top view in FIG. 16.

FIGS. 11 to 14 illustrate sequential steps in the transfer of a folded sheet element 24 to the storage and transport system 5.

In accordance with a feature of the invention, the deflection wheel 15 of the belt 13 carrying fingers 12 and the deflection wheel 47 of the transport belt 26 are radially offset with respect to each other so that the paths of the transport belt system 25, 26 and of the finger carrying belt 13 will differ. The fingers 12 will follow the circular path of the gear belt 13, thus separating from the surface of the belt 26. Since the fingers are positioned between the sheet halves or sheet units 20, 22, the circular path of the fingers 12 on belt 13 pushes the sheet halves or units away from each other and causes spreading thereof - see FIG. 16.

Figure 11:
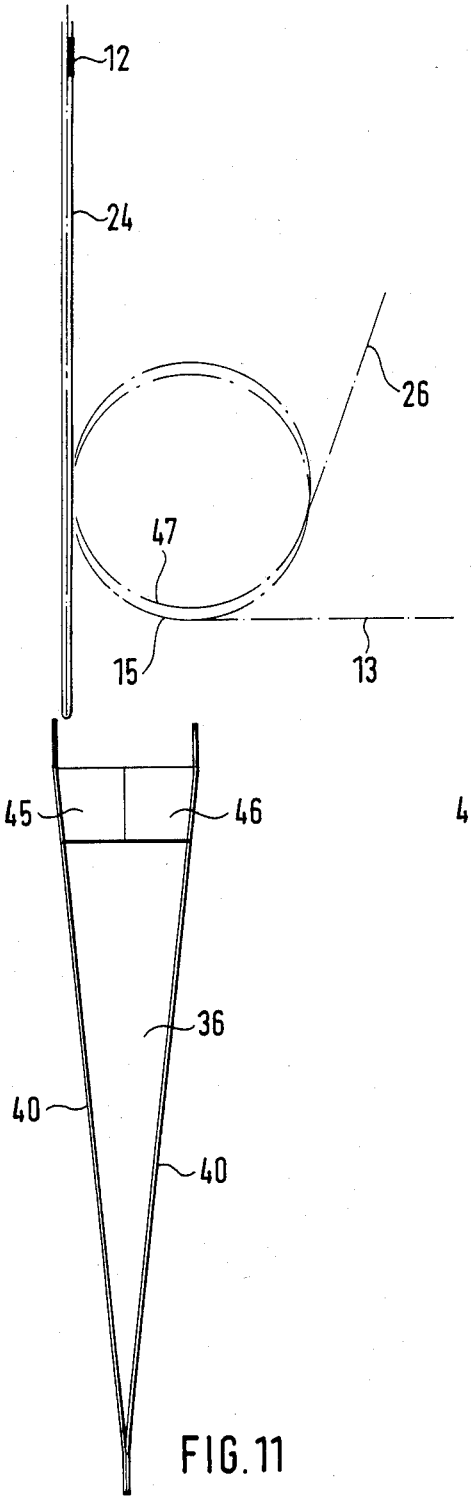
Figure 12:
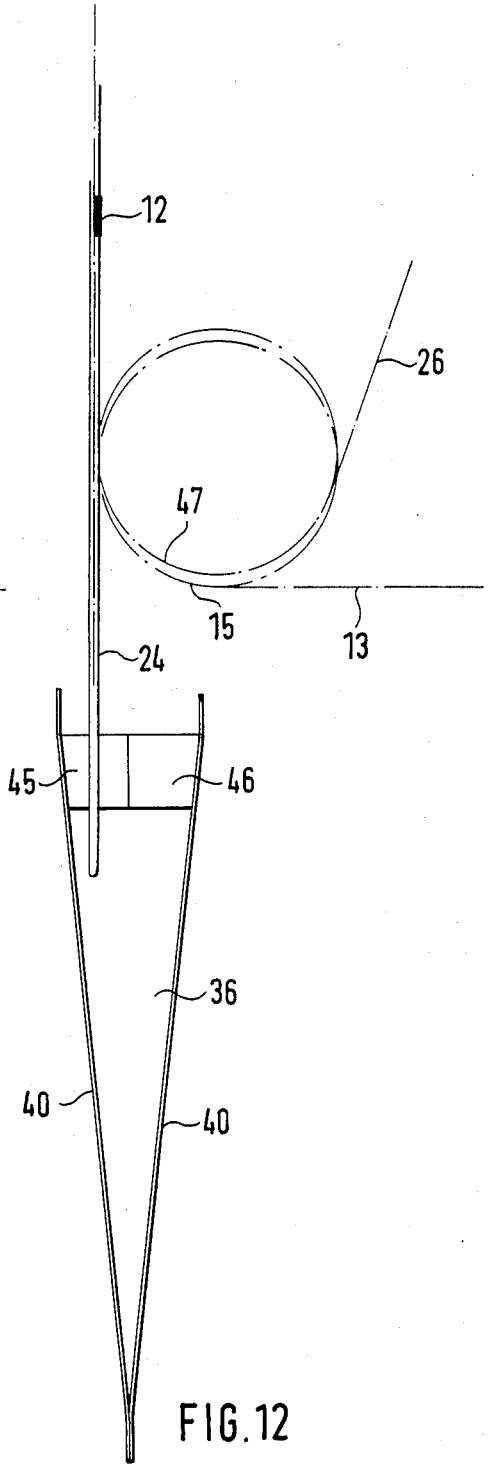
Figure 13:
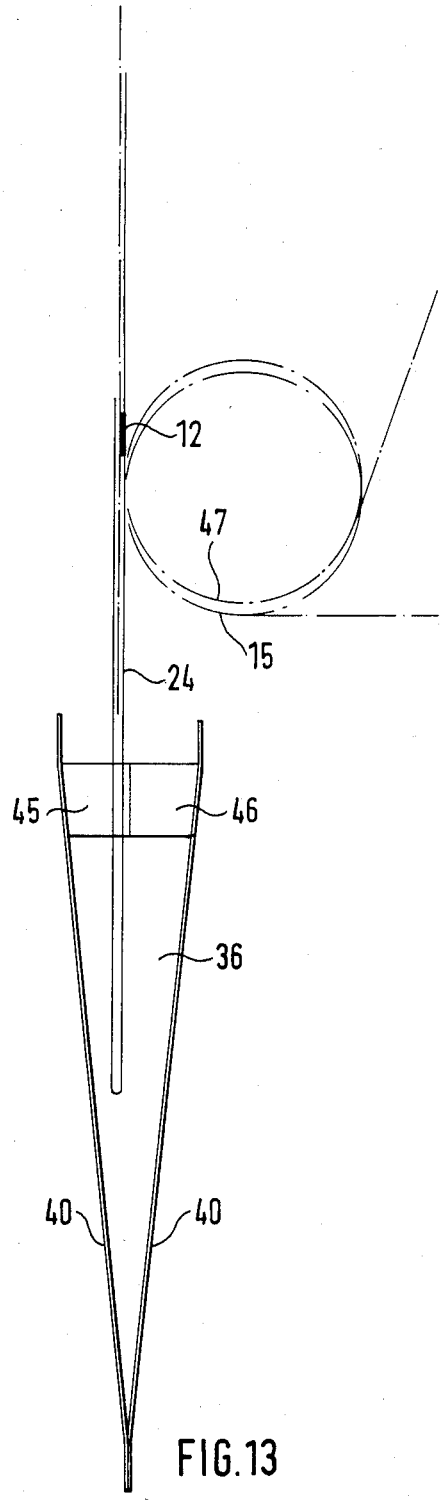
Figure 14:
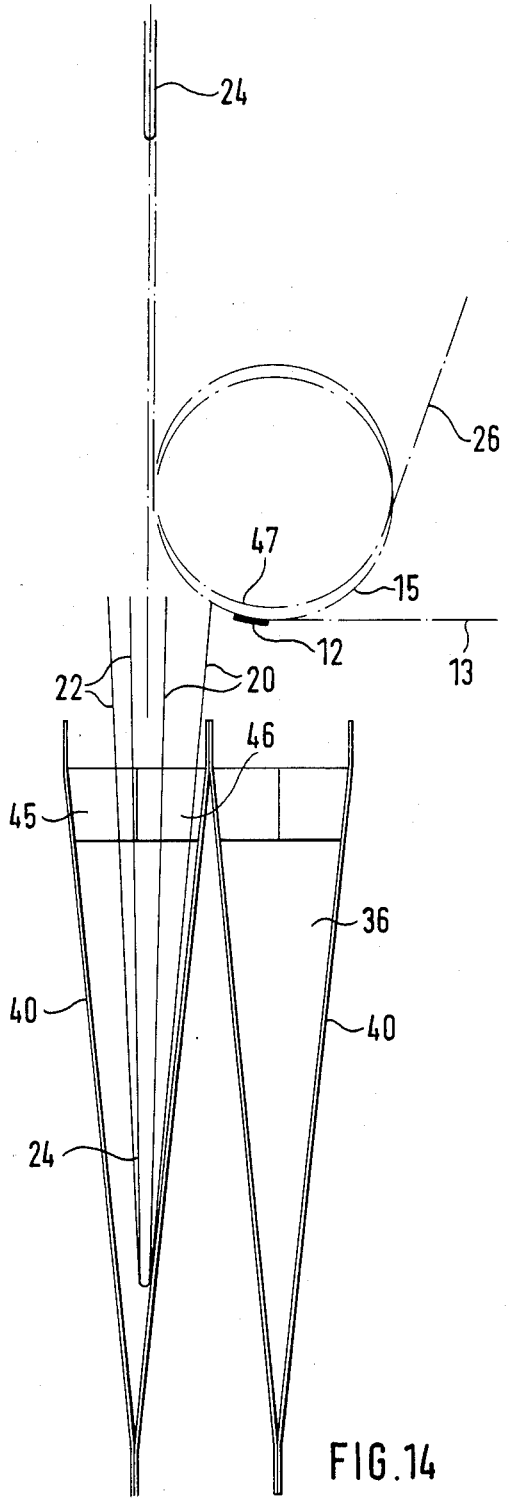

FIG. 11 shows an arriving sheet unit 24, with finger 12 close to the trailing edge; FIG. 12 illustrates the initial insertion step of a unit 24 with another unit 24 shown only in single-line representaton, with a single sheet therein; FIG. 13 illustrates the further progress of the sheet 24 into the open pocket formed by two adjacent sheets 40 of the sheet-metal package; and FIG. 14 the spreading-apart of two interleaved folded sheets 24, with the respective sheet elements 20, 22, and entry of another sheet thereinto.

Figure 15:
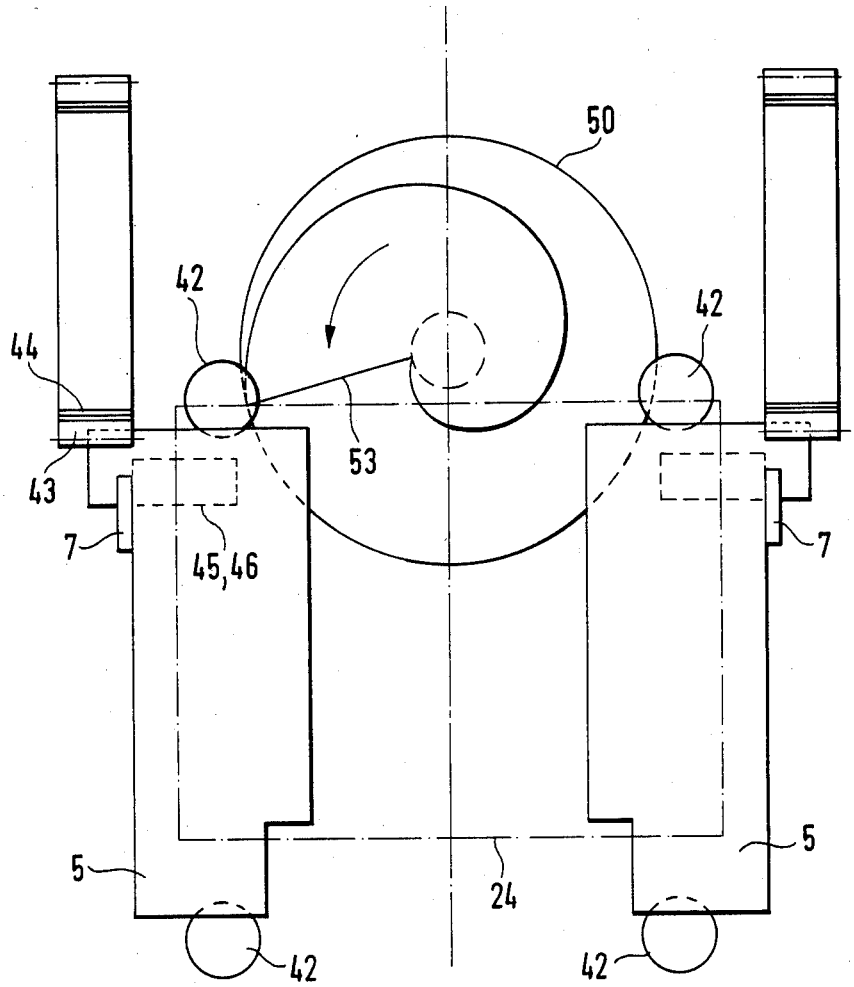
FIG. 15 is a view in the direction of arrow IV of FIG. 2.
Figure 16:
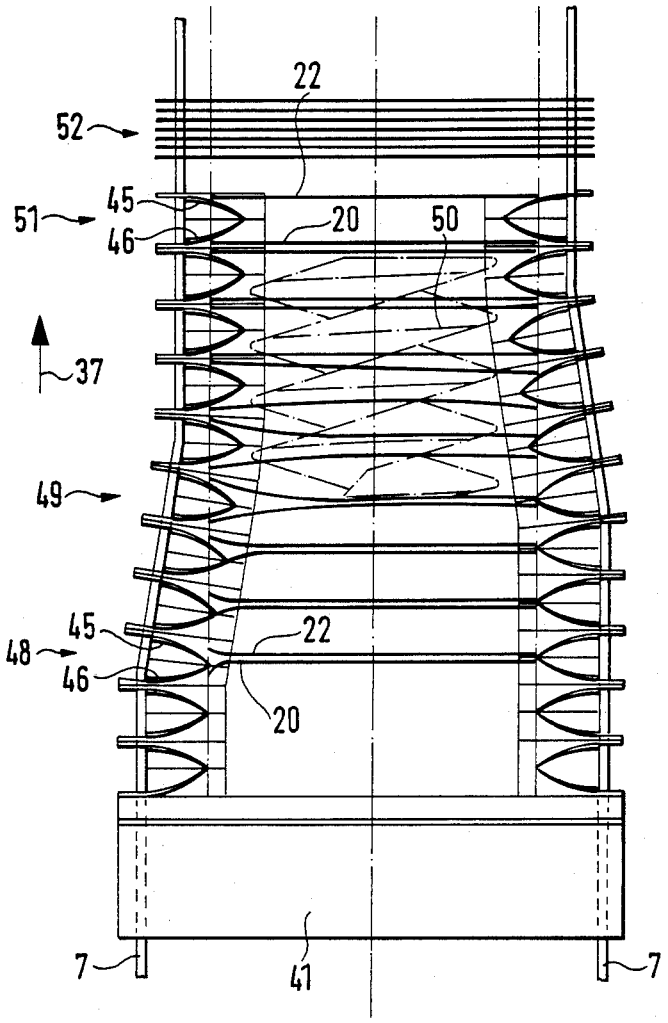
FIG. 16 is a view taken in the direction of arrow V of FIG. 2.

The further stages in the receipt of the sheet are best seen in FIG. 16, which is a view in the direction of the arrow V of FIG. 2. The two arched tongues 45, 46 penetrate between the spread ends of the sheet halves 20, 22 of the folded element or units 24. The rails 7 are first flared, as best seen in FIG. 16, and then narrow in the direction of the transport, see of arrow 37. This narrowing of the rails 7, upon simultaneous transport movement in the direction of the arrow 37, causes the arches 45, 46 to press the halves 20, 22 of the folded units 24, or of the sheets 20, 22 on one side of the folded element 24 further and further apart. At region 49, the rotating worm 50 engages between the halves 20, 22 of units 24 and extends or pulls the spread opening of the sheets towards the other side, in FIG. 16 towards the right, of the folded element 24. The arched tongues 45, 46 at the right, or other half of the transport and storage system 5 can then likewise penetrate into the open folded element 24, see the section between regions 49 and 51. At the region 51 - FIG. 16 - all the arches 45, 46 are located between the halves or elements 20, 21 of the folded sheet 24. This is the position in which the transport and storage system, as seen in the region 52, can be compressed and, as described in connection with FIG. 1, can be stored in a holder 8. When the transport and storage system 5 is pulled out from a holder 8, the folded elements will spread apart, so that inserts can readily be inserted therein. The arched elements 45, 46 can compress towards each other in the region 52. FIG. 15 is a view in the direction VI of FIG. 2, and illustrates the engagement of the worm 50, starting with a starting turn line 53, as described above. The worm 50 engages, beginning at the region 49 (FIG. 16), the sheet halves 20, 22 which are already spread apart at one side. Due to its rotation in counterclockwise direction, it pulls the opening also towards the other side - in FIG. 16 towards the right side of the folded sheet, permitting engagement of the arched elements 45, 46 both on the right as well as on the left side of the sheet, and, due to the narrowing of the tracks 7, engagement between the sheet elements 20, 22. The folded unit 24 remains open at the open end thereof in the entire region of the worm 50 during the feed by rotation of the worm and movement of the transport and storage system. Thus, the movement by the worm 50 insures that all folded units are reliably accepted by the transport and storage system 5.

Figure 17:
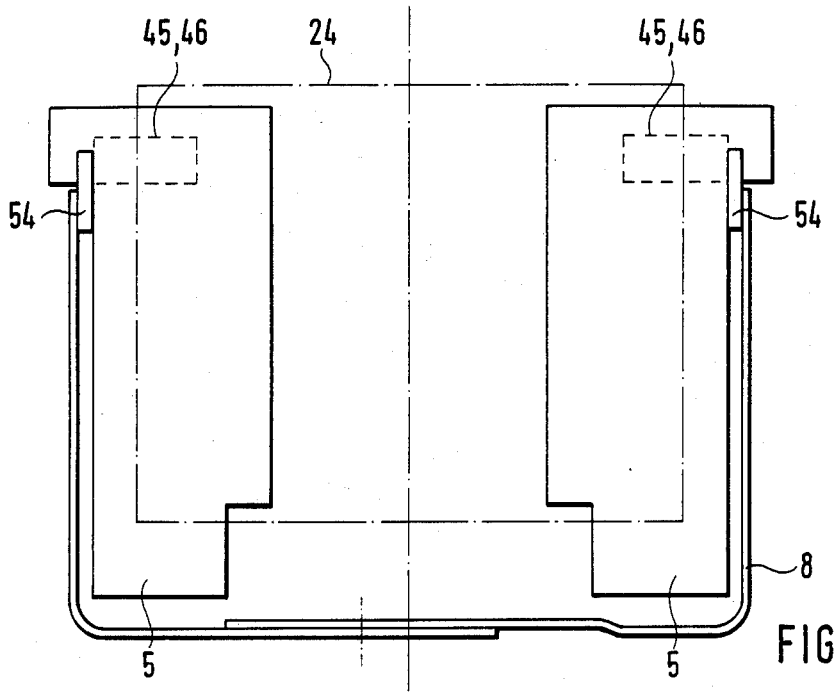
FIG. 17 is a side view of a storage unit.

FIG. 17 illustrates a further embodiment to store the holders 8. A portion of the transport and storage system 5, with the folded units 24 therein, is located on rails 54. A stop 55—shown schematically in FIG. 1—prevents sliding-out of the holder 8. The stop 55 can be pulled back by any suitable apparatus, not further shown, or manually, upon reception or removal of a partial unit of the transport system.

Figure 19:
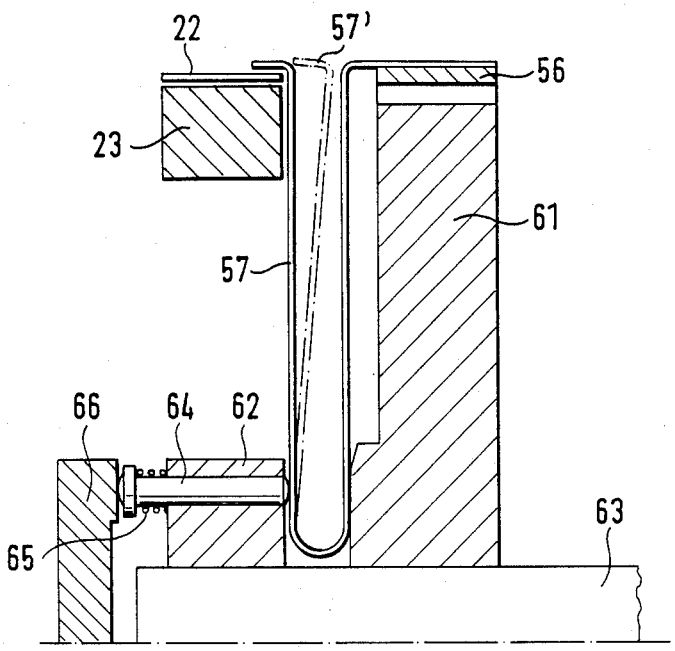
FIG. 19 is a half-sectional view along line VI—VI of FIG. 18.
Figure 18:
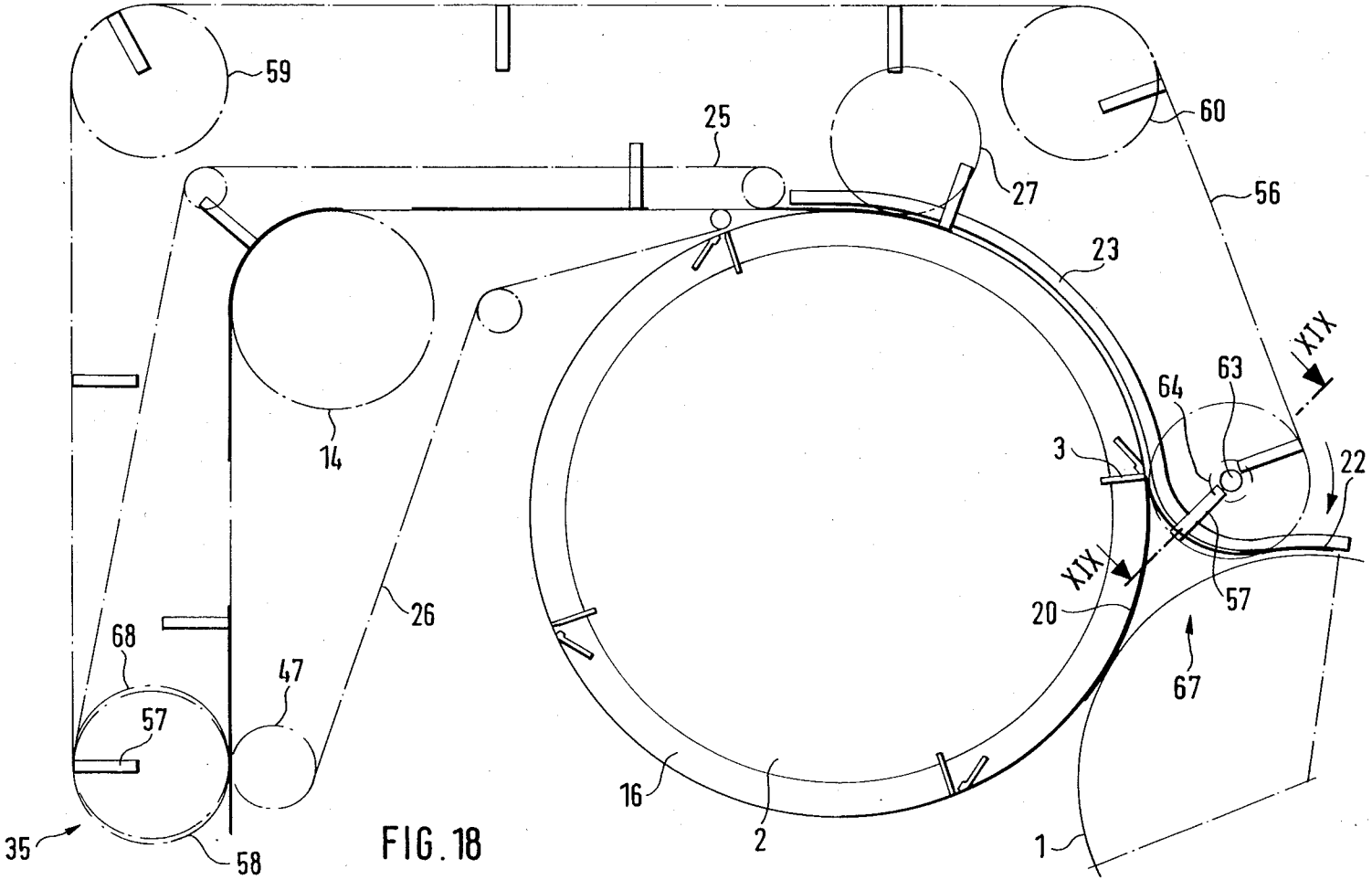
FIG. 18 illustrates another embodiment for the formation of fingers, and control of the fingers.

FIGS. 18 and 19 illustrate another embodiment of the invention in which the fingers are guided differently. The general structure is similar to that described in connection with FIG. 3. FIG. 18 shows the arrangement in which a finger 57, located on a gear belt or on a chain 56, engages beneath the sheet half 22, before the folded unit is closed. The belt 56 is engaged at its back on a disk 16 located on the end face of the folding flap cylinder 2, and is guided over support rollers 14 and 58 to 60. It is driven by a drive wheel 61. FIG. 19 illustrates a section along line VI—VI of FIG. 18 in order to illustrate the control of the finger.

The drive wheels or disks 61, 62 are securely connected to a drive shaft 63. They rotate in clockwise direction see FIG. 18. Disk 62 has, axially shiftably thereon, a bolt 64 which is pressed by a spring 65 against a fixed cam disk 66. The finger 57 is guided by the belt 56 at the appropriate speed, tangentially between the disks 61, 62. Bolt 64 will engage the finger 57 due to the cam stroke or cam curve shape of the cam disk 66, thereby moving the finger from the full-line position shown in FIG. 19 to the broken-line position at 57'. Thus, it can engage between the sheet halves 20, 22 in the region 67 (FIG. 18).

The position at the release or transfer to the storage system in the region 35 in the embodiment of FIG. 18 is the same as that illustrated in connection with FIG. 3. The guide wheels 58, 68 of the gear belt 56 and of the transport belt 25 are offset with respect to each other, so that finger 57, upon rotation in counterclockwise direction and feathering the folded unit 24, comes free from the belt 25 and thus the sheet half unit 22 carried or engaged thereby.

The invention is not restricted to reception and further transport of finished folded copy products or other substrates, folded on a folding flap cylinder or in a folding apparatus. Sheets which are carried adjacent each other on transport belts 25, 26, for example together in pairs or stacked above each other, can be opened or separated by inserting fingers, as described.

Various changes and modifications may be made within the scope of the inventive concept.

What is claimed:

1. Apparatus for transporting adjacently positioned substrate sheets (20, 22, 24) from a supply means (1, 2) to a receiving system (5) and at least partly spreading apart said sheets, particularly for printed copy paper substrate sheets, comprising a transport belt system (25, 26) positioned to transfer the sheets from the supply means (1, 2) and for delivering the sheets to the receiving system (5);

an endless belt means (13) located adjacent a part of the path of the transport belt system (25, 26);

a plurality of fingers (12) laterally projecting from said endless belt means (13), said fingers being engageable between adjacent sheets (20, 22); and means (15) for guiding said endless belt means (13) in a guide path which departs from the path of said transport belt system (25, 26) at least in a region (35) adjacent the receiving system (5) and spreading apart the sheets between which the fingers are engaged.

2. The apparatus of claim 1, wherein the supply means comprises a rotating cylinder (1);

and wherein the fingers (12) laterally projecting from the endless belt means (13) engage between adjacent sheets while said adjacent sheets are still positioned at least in part on the rotating cylinder (1).

3. The apparatus of claim 1, wherein, at least in the region (35) adjacent the receiving system (5), said fingers are positioned, with respect to the transport direction of the transport belt system (25, 26), on a zone of the sheet elements near the trailing ends of the sheet elements.

4. The apparatus of claim 1, wherein said means (15) for guiding said endless belt means (13) in a guide path guides said endless belt means in a path in which the fingers (12) withdraw from between said sheets (20, 22).

5. The apparatus of claim 1, wherein the supply means comprises a receiving cylinder (2) having gripping means (3) formed thereon located adjacent a rotating cylinder (1) and receiving the sheets (20, 22) from the rotating cylinder;

a disk rotatable with respect to said receiving cylinder located axially adjacent an end face of said receiving cylinder;

wherein said endless guide belt means (13) is guided about said disk (16), and wherein the operating speed of said endless guide belt means is less than the operating speed of the transport belt system.

6. The apparatus of claim 5, wherein said rotating cylinder is formed with recesses (18) positioned to receive respective ones of said plurality of fingers (12) for engagement beneath a sheet or a first sheet half (20) still positioned on said rotating cylinder.

7. The apparatus of claim 6, wherein (FIG. 5) the fingers snap laterally beneath said sheet or first sheet half (20) still on the rotating cylinder.

8. The apparatus of claim 1, wherein the transport belt system includes at least one transport belt (26) and a deflection cylinder or roller (47) for guiding said at least one transport belt in a predetermined path; and wherein the means for guiding said endless belt means in a path differing from the path of the transport belt system comprises a rotating cylinder or roller (15) for guiding said endless belt means;

and having an axis of rotation which is offset with respect to the axis of rotation of the deflection cylinder or roller (47).

9. The apparatus of claim 8, wherein said fingers have a fixed orientation with respect to said belt means (13) and are positioned essentially parallel to the major extent of the plane of said sheets, said fingers, upon said belt means passing over the rotating cylinder or roller, twisting transversely with respect to the major plane of the sheet elements and thus spreading apart adjacent sheet elements.

10. The apparatus of claim 6, further including a cam track (32, 34) coupled to rotate with the receiving cylinder (2);

spring bias bolts securing said finger (12) and engageable in the recess (18) of the rotating cylinder (1) and beneath the sheet or half element (20) still on said rotating cylinder when moved in said position by engagement with the cam track.

11. The apparatus of claim 10, wherein said bolts are secured to the endless guide belt means and restrained from rotation with respect thereto.

12. The apparatus of claim 1, wherein the supply means includes (FIGS. 18,19) a receiving cylinder (2) located adjacent a rotating cylinder (1) and receiving said sheets therefrom, the rotating cylinder and the receiving cylinder defining, adjacent a mutual circumferential region, a generally V-shaped region;

a deflection roller (61) located in said generally V-shaped region;

and wherein said endless belt means (13) is guided about said deflection roller (61) to guide said fingers (57) between adjacent sheets being transferred from said rotating cylinder to said receiving cylinder.

13. The apparatus of claim 12, wherein the fingers are U-shaped spring elements, formed with a projecting terminal finger portion and extending laterally from said guide belt means (13);

and a stationary cam track (66) controlling lateral position of said fingers for engagement between the sheet elements (20, 22) being transferred.

14. The apparatus of claim 1, wherein the receiving system comprises a storage unit (5), wherein said storage unit includes a selectively expandible and compressible zig-zag or accordion-pleated unit defining, when spread apart, a plurality of open receiving chambers (36);

and wherein the means for guiding said endless belt means in the region (35) adjacent the storage unit guide the endless belt means and said transport belt system (25, 26) in a path which guides the sheets into a respectively open chamber upon spreading apart of the chambers.

15. The apparatus of claim 14, further including a worm (50) engageable between adjacent chambers of the storage unit (5) for spreading apart the chambers of the storage unit.

16. The apparatus of claim 1, wherein the supply means includes a receiving cylinder (2) located adjacent a rotating cylinder (1);

the transport belt system (25, 26) being positioned to receive the sheets from the receiving cylinder (2);

a transport cylinder (27) transporting the sheets on the receiving cylinder to the transport belt system;

and wherein the transport belt system and the endless belt means (13) operate at a linear speed which is slower than the circumferential speed of the receiving cylinder (2), the transport cylinder decelerating the sheets for transport to the transport belt system.

17. The apparatus of claim 1, wherein the supply means includes a folding flap cylinder (2) and a folding blade cylinder (1) positioned adjacent the folding flap cylinder (2);

said cylinders (1, 2) upon positioning of a sheet thereon, providing a transverse fold on a sheet to define a folded edge or spine of the sheet, gripped in the folding flaps of the folding flap cylinder (2), and leaving two adjacent sheet elements (20, 22) on the rotating folding blade cylinder;

and wherein said fingers engage between said sheet elements.

18. The apparatus of claim 17, wherein the transport speed of said transport belt system (25, 26) and the operating speed of said endless belt means (13) are only approximately the same, and a slower than the operating speed of said folding flap cylinder (12);

the placement of said fingers on the endless guide belt means, and the rotary speed of said folding flap cylinder (12) being mached for engagement of the fingers between the sheet elements (20, 22) of the folded sheets behind the fold or spine and, upon transport of the folded sheets, for gradual sliding of the fingers towards a trailing portion of said sheet elements, away from said fold or spine, until transfer of the folded sheets to said transport belt system (25, 26), said fingers remaining between said sheet elements (20, 22) until at least just about withdrawal of the fingers from between said sheets in the region (35) adjacent the receiving system (5).

19. The apparatus of claim 1, wherein said fingers have a fixed orientation with respect to said belt means (13) and are positioned essentially parallel to the major extent of the plane of said sheets;

and wherein said means for spreading said sheets apart comprises belt guide means (15) for guiding said belt means (13) in a direction at an angle to the direction of movement of the sheet elements (20, 22) to twist said fingers transversely to the major plane of the sheet elements and thus spread apart adjacent sheet elements.

20. Apparatus for transporting adjacent sheets or folded sheet elements (20, 22), particularly printed copy products, comprising, in accordance with the invention, a transport belt system (25, 26) positioned to transport the sheets in a predetermined path;

an endless belt means (13) located laterally adjacent the predetermined path of the transport belt system for a portion of said predetermined path;

a plurality of fingers (12) laterally projecting from said guide belt means (13) and engaged between adjacent sheets (20, 22) while said adjacent sheets are held and transported by said transport belt system;

means (1, 18, 28, 32, 61, 66) introducing said fingers between said sheet elements;

and means, including means for guiding said endless belt means in a path differing from the predetermined path of said transport belt system (25, 26), to spread said sheet elements apart in a delivery region (35).

21. The apparatus of claim 20, wherein said fingers have a fixed orientation with respect to said belt means (13) and are positioned essentially parallel to the major extent of the plane of said sheets;

and wherein said means for spreading said sheets apart comprises belt guide means (15) for guiding said belt means (13) in a direction at an angle to the direction of movement of the sheet elements (20, 22) to twist said fingers transversely to the major plane of the sheet elements and thus spread apart adjacent sheet elements.

22. The apparatus of claim 20, further comprising a worm (50) engageable between the spread-apart sheet elements.

23. The apparatus of claim 22, further including a zig-zag or accordeon-pleat storage unit (5) having adjacently located storage chambers;

and wherein said worm (50) is engageable with means defining said chambers to spread said chambers apart for reception of the spread-apart sheet elements.

24. The apparatus of claim 20, wherein said sheet elements (20, 22) are part of a folded sheet (24) defining a spine or fold between said sheet elements;

and wherein said transport belt system transports said sheets with the spine or fold in leading direction, and said fingers, in the region adjacent the means for spreading the sheets, are located in a zone of the sheet elements near the trailing ends thereof.

* * * * *